United States Patent [19]

Richardson, Jr.

[11] 3,996,761

[45] Dec. 14, 1976

[54] RECIPROCATING COMPRESSOR

[75] Inventor: Hubert Richardson, Jr., Kirkville, N.Y.

[73] Assignee: Carrier Corporation, Syracuse, N.Y.

[22] Filed: Dec. 30, 1975

[21] Appl. No.: 645,162

[52] U.S. Cl. ..... 62/196 C; 417/292; 417/299

[51] Int. Cl.[2] ..... F04B 49/02; F25B 31/00

[58] Field of Search ..... 62/196 C; 417/292, 299

[56] References Cited

UNITED STATES PATENTS

| | | | |
|---|---|---|---|
| 1,607,657 | 11/1926 | Whitehead | 236/64 |
| 3,606,588 | 9/1971 | Romerhaus | 417/292 |

*Primary Examiner*—Alan Cohan

*Attorney, Agent, or Firm*—J. Raymond Curtin; Barry E. Deutsch

[57] ABSTRACT

A reciprocating compressor including a valve plate mounting a discharge valve to control the flow of compressed gas through an opening formed in the valve plate. The discharge valve is formed from a bimetallic element and is mounted in a normally open position with respect to the discharge opening in the valve plate to permit fluid leakage from the compressor cylinder through the opening upon startup of the compressor. The discharge valve warps to a closed position relative to the opening in the valve plate as the temperature of the gas increases due to the compression thereof by operation of said piston.

3 Claims, 4 Drawing Figures

RECIPROCATING COMPRESSOR

BACKGROUND OF THE INVENTION

This invention relates to improvements in reciprocating compressors, and in particular, to an unloading system operable to reduce the load on the compressor motor upon initial startup thereof.

Reciprocating compressors are employed in many varied applications. In a number of such applications, the compressor is designed to operate under a constant load. Accordingly, an electric motor typically employed to drive such compressor may be chosen to provide sufficient torque to handle the load imposed thereon even during initial starting conditions. It is understood, the motor will not provide its maximum torque until it obtains normal operating speed.

In other applications, the compressor operates in systems wherein a variable load is imposed on the compressor. Although the electric motor may be chosen to provide sufficient torque at starting conditions to manage the maximum load, the use of such a motor would not be economical. The relatively few times the motor would be employed under such adverse conditions does not generally warrant the increased cost in providing windings capable of carrying the large flow of current that would occur during the starting period of a compressor having a relatively large load imposed thereon.

The use of a compressor in a refrigeration unit is a typical variable load application. At times when the ambient temperature is at a relatively high level, the condensing pressure of the unit is similarly at a high level. Compressor discharge pressure is slightly above condenser pressure. Accordingly, the load on the compressor is relatively high.

Under heavy load conditions, the motor will draw excessive current in an attempt to produce the necessary torque to obtain operating speed. The excessive current may damage the motor windings, or if provided with an overload protection device, the device may trip to stop the motor. If the load imposed on the compressor is unusually large, the motor may stall producing lock rotor conditions which may result in the total destruction of the motor.

In U.S. Pat. No. 1,607,657, there is disclosed a thermostatic controlled needle valve to permit the cylinder of the compressor to be vented to atmosphere to facilitate starting of the compressor. The use of an expansible bellows in combination with a needle valve provides a rather costly and cumbersome arrangement to obtain the desired reduced load on the compressor during the startup thereof.

It has been determined that, the initial load on the compressor may be effectively reduced by maintaining the discharge valve controlling the flow of compressed fluid from the compressor's cylinder, in an open state to permit the compressor motor to attain normal operating speed. By maintaining the discharge valve in an open state, the pressure differential between the suction side and the discharge side of the compressor is reduced, thereby decreasing the initial load on the compressor.

SUMMARY OF THE INVENTION

Accordingly, it is an object of this invention to reduce the initial load imposed on a compressor.

It is a further object of this invention to automatically reduce the load imposed on the compressor to facilitate the starting thereof.

It is a further object of this invention to unload a compressor during startup conditions by highly reliable, compact and relatively inexpensive unloading means.

These and other objects of the present invention are attained in a reciprocating compressor having a valve plate mounting a discharge valve to control the flow of compressed fluid from the cylinder of the compressor. The discharge valve is formed from a bimetallic element and is in a normally open position when the temperature of the compressed fluid is at a relatively low level. The discharge valve assumes a closed position as the temperature of the fluid increases due to continued operation of the compressor.

DESCRIPTION OF THE PREFERRED EMBODIMENT

Figure 1:
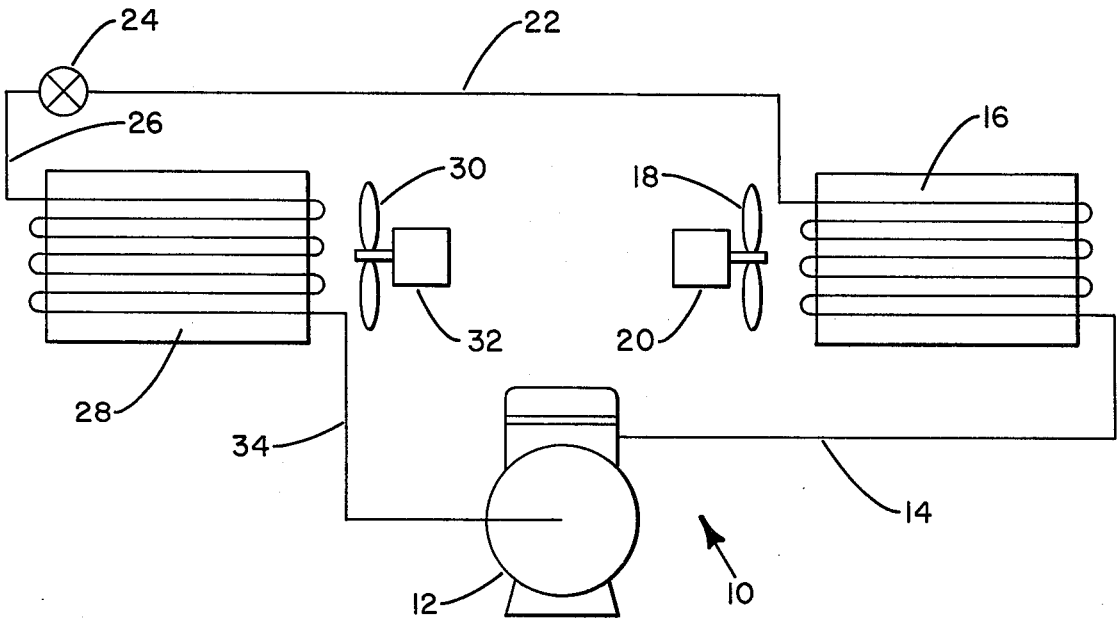
FIG. 1 is a schematic illustration of a unit employing a compressor including the present invention.

Referring now to the drawings, there is shown a preferred embodiment of the present invention. In referring to the various figures of the drawings, like numerals shall refer to like parts.

FIG. 1 illustrates a refrigeration unit typically employed in an air conditioning system. A refrigeration unit represents a variable load application in which the instant invention may be suitably employed.

Refrigeration unit 10 includes compressor 12 which supplies a relatively high pressure compressed refrigerant through conduit 14 to a first heat exchanger 16 functioning as a refrigerant condenser. A suitable cooling medium, such as ambient air, is routed in heat transfer relation with the refrigerant gas flowing through the condenser whereby the refrigerant gas is condensed. A fan 18 suitably connected to a prime mover such as electric motor 20, is provided to route the ambient air in heat exchange relation with the refrigerant gas.

The condensed refrigerant passes from heat exchanger 16 through line 22, thermal expansion means 24, line 26, into a second heat exchanger 28 serving as a refrigerant evaporator. A medium to be cooled, for example air to be delivered to a space being conditioned, is passed in heat transfer relation with the refrigerant passing through evaporator 28. The medium rejects heat to the refrigerant and is cooled thereby. A fan 30, connected to a prime mover such as electric motor 32, is provided to pass the air in heat transfer relation with the refrigerant flowing through the evaporator. The cooled air is passed to the space being conditioned via suitable duct means not shown. The vaporous refrigerant passes from evaporator 28 through line 34 to the suction side of compressor 12. The refrigeration unit thus described is conventional within the art and no further explanation is deemed necessary.

Figure 3:
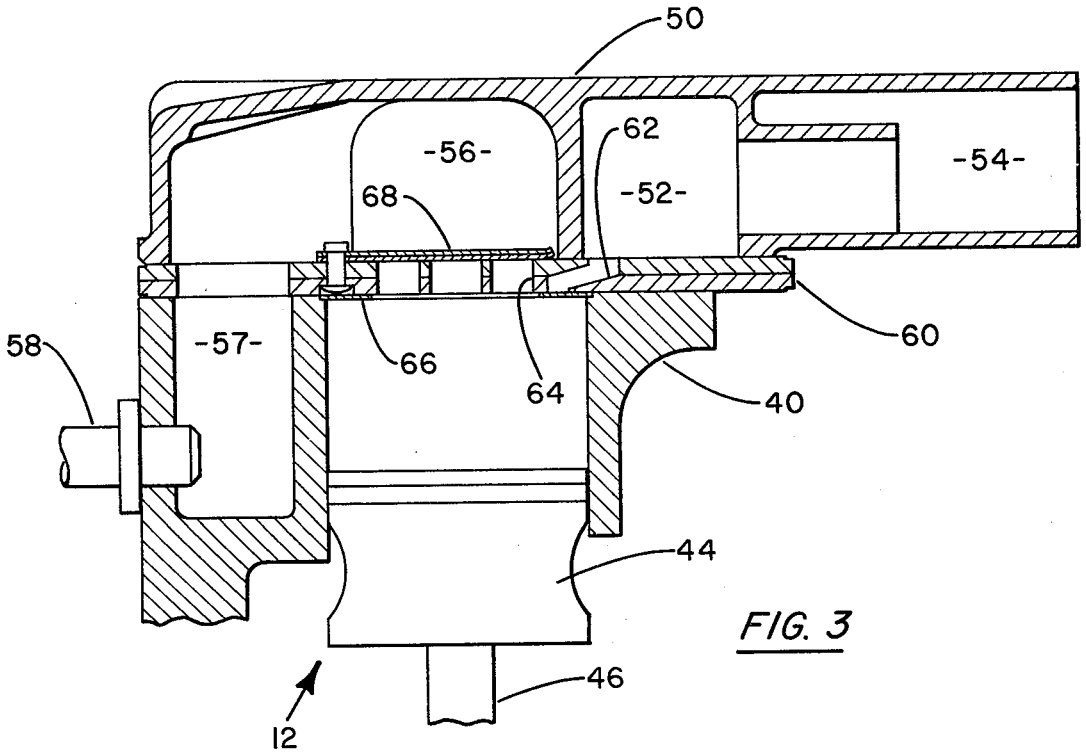
FIG. 3 is a view similar to FIG. 2 further illustrating the present invention.
Figure 2:
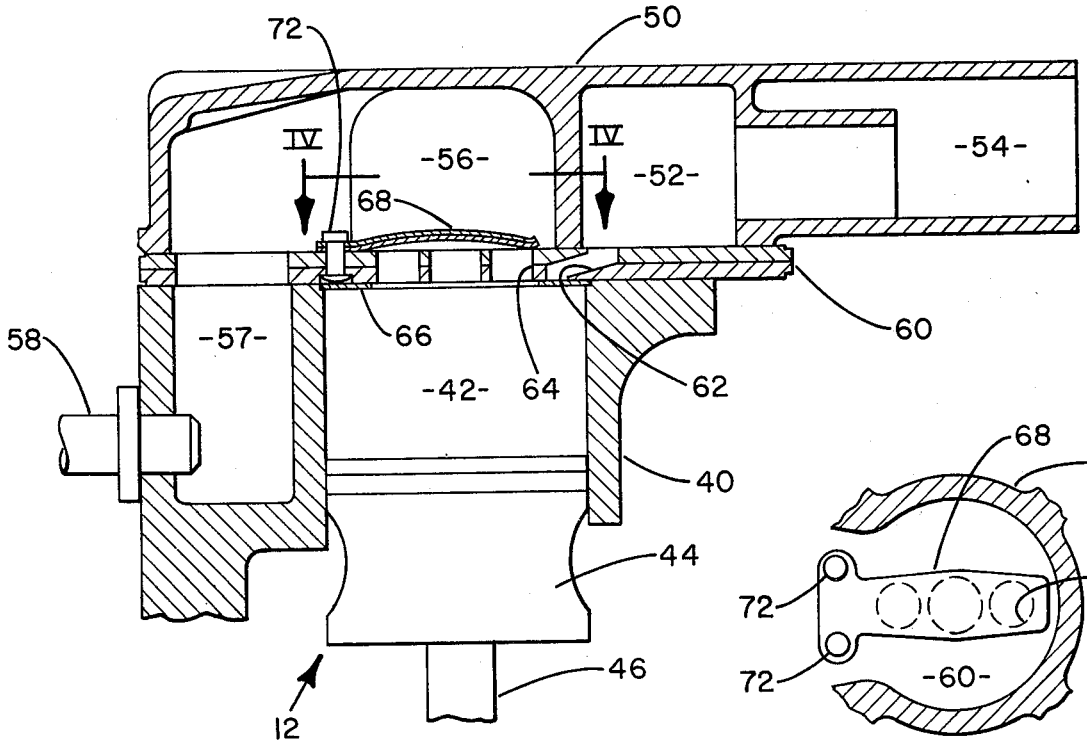
FIG. 2 is a longitudinal sectional view of a portion of the compressor showing details of the present invention.

Referring now to FIGS. 2 and 3, there is illustrated sectional views of a portion of compressor 12. Compressor 12 includes a cylinder block 40 defining a cylinder 42 in which a piston 44 is disposed for reciprocal movement therein. Piston 44 is connected via connecting rod 46 to a crank shaft (not shown) whereby, as is well known, rotation of the shaft will cause the reciprocal movement of the piston. A cylinder head 50 is suitably connected to the cylinder block. Cylinder head 50 includes a chamber 52 for receiving suction gas from conduit means 54 and line 34. Cylinder head 50 includes a second chamber 56 for receiving compressed refrigerant gas from the cylinder. The gas in chamber 56 flows to a second chamber 57 in cylinder block and thence passes through conduit means 58 to line 14.

Figure 4:
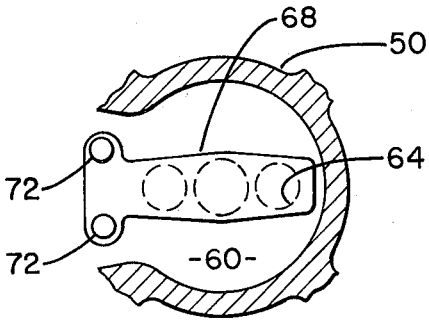
FIG. 4 is a sectional view, taken along the lines IV—IV of FIG. 2.

Compressor 12 further includes a valve plate 60 having suction ports 62 and discharge ports 64 provided therethrough. A suction valve 66 is provided to control the flow of suction fluid from chamber 52 into compressor cylinder 42. A discharge valve 68, to be discussed more fully hereinafter, is provided to control the flow of compressed gas from the cylinder into discharge chamber 56 of cylinder head 50. Valve 66 is supported upon a stepped surface of cylinder 42. Valve 68 is suitably attached to the valve plate via suitable means such as rivets 72. A detailed view of valve plate 60 and discharge valve 68 is shown in FIG. 4.

Discharge valve 68 is formed from a bimetallic element. As illustrated in FIG. 2, valve 68 is formed so that discharge ports 64 are slightly uncovered when the valve is in a cold state. The valve may thus be described as a normally open valve.

Upon initial startup of the compressor, valve 68 is in the position illustrated in FIG. 2. Thus, as piston 44 moves within cylinder 42 to compress the gas delivered thereinto from suction chamber 52, maximum operating pressure will not be attained. The reduced discharge pressure results from the partial continuous opening of discharge ports 64.

By limiting the maximum discharge pressure attained during startup conditions to a pressure substantially beneath normal operating pressure, the initial load imposed on the compressor motor will be reduced. By reducing the initial starting load, the possibility of damage to the compressor motor is minimized. Even though the pressure within the cylinder is maintained below normal operating pressure, the pressure and thus temperature of the gas compressed within the cylinder will still increase. Valve 68 is subjected to the increased temperature gas discharged through ports 64. The relatively hot gas causes the bimetal valve to warp to a closed position as illustrated in FIG. 3. By assuming the position illustrated in FIG. 3, the valve closes ports 64 so that normal operating pressures may be obtained within the compressor cylinder. The valve thereafter functions as a normal discharge valve in controlling the flow of compressed fluid from cylinder 42 to chamber 56.

It has been found that as valve 68 moves towards the closed position illustrated in FIG. 3 as a result of the relatively warm compressed gas flowing thereover, the pressure differential established across the valve substantially increases due to the limited flow opening provided through ports 64. The pressure differential generates a force acting to quickly snap valve 68 into its closed position.

If it is desired to improve the wear characteristics of the bimetallic discharge valve, the bimetallic element forming the valve may have a sleeve formed from standard valve material placed thereover in overlying relationship with ports 64. In an arrangement of this type, the bimetallic element would, in effect, function as an actuator for the discharge valve.

The present invention provides an efficient and relatively inexpensive means for reducing the starting load imposed on the compressor motor. As noted previously, the present invention finds particular utility when employed in applications involving a variable starting load.

While a preferred embodiment of the present invention has been described and illustrated, the invention should not be limited thereto but may be otherwise embodied within the scope of the following claims.

I claim:

1. In a reciprocating compressor operable to provide a relatively high pressure gas and including a cylinder having a reciprocally movable piston disposed therein, and a valve plate mounting a discharge valve to control the flow of the compressed fluid through an opening formed in the valve plate, wherein the improvement comprises:

said discharge valve being formed from a bimetallic element and being mounted in a normally open position with respect to said discharge opening in said valve plate to permit fluid leakage from said cylinder through said opening upon startup of said compressor, said discharge valve warping to a closed position relative to said opening as the temperature of the fluid increases due to the compression thereof by movement of said piston in said cylinder.

2. The combination in accordance with claim 1, wherein the compressor is employed in a refrigeration unit.

3. The combination in accordance with claim 1 wherein a force developed by the pressure differential across said valve plate established by the movement of said discharge valve towards a closed position from its normally open position snaps said valve closed with respect to said fluid opening in said valve plate, said valve thereafter opening in response to the pressure of said compressed fluid in said cylinder.

* * * * *